United States Patent [19]

Katona

[11] 4,206,338

[45] * Jun. 3, 1980

[54] SELF-CONTAINED WINDOW UNIT FOR OVEN DOORS (COMMON CAVITY)

[75] Inventor: Joseph W. Katona, Walled Lake, Mich.

[73] Assignee: Mills Products, Inc., Farmington, Mich.

[ * ] Notice: The portion of the term of this patent subsequent to May 17, 1994, has been disclaimed.

[21] Appl. No.: 898,011

[22] Filed: Apr. 24, 1978

Related U.S. Application Data

[63] Continuation-in-part of Ser. No. 797,256, May 16, 1977, abandoned, which is a continuation-in-part of Ser. No. 657,472, Feb. 12, 1976, Pat. No. 4,023,554, and Ser. No. 681,456, Apr. 29, 1976, Pat. No. 4,049,939.

[51] Int. Cl.[2] ..... H05B 9/00

[52] U.S. Cl. ..... 219/10.55 D; 126/200

[58] Field of Search ..... 219/10.55 D, 10.55 R; 126/200, 273 R, 198; 52/616, 304, 399

[56] References Cited

U.S. PATENT DOCUMENTS

| | | | |
|---|---|---|---|
| 3,021,832 | 2/1962 | Mills | 126/200 |
| 3,219,026 | 11/1965 | Larkin | 126/200 |
| 3,228,388 | 1/1966 | Mills | 126/200 |
| 3,577,973 | 5/1971 | Katona | 126/200 |
| 3,664,326 | 5/1972 | Mills | 126/200 |
| 3,665,915 | 5/1972 | Katona | 126/200 |
| 3,855,994 | 12/1974 | Evans et al. | 126/200 |
| 4,023,554 | 5/1977 | Katona | 126/200 X |
| 4,041,930 | 8/1977 | Katona | 126/200 X |
| 4,043,091 | 8/1977 | Katona | 219/200 X |
| 4,049,939 | 9/1977 | Katona | 219/10.55 D |

*Primary Examiner*—Arthur T. Grimley
*Attorney, Agent, or Firm*—Whittemore, Hulbert & Belknap

[57] ABSTRACT

A self-contained window unit adapted to be assembled into an oven door, having three glass panes and a microwave shield. Two of the glass panes are held in spaced parallel relation by a frame of electrically-conducting material which has a peripheral mounting flange in electrical contact with the edge of the microwave shield. The third pane is secured to the frame by a plurality of individual mounting clips. Fasteners around the four sides of the window unit secure the mounting flange to the door to both mount the window unit and ground the microwave shield.

20 Claims, 2 Drawing Figures

SELF-CONTAINED WINDOW UNIT FOR OVEN DOORS (COMMON CAVITY)

REFERENCE TO RELATED APPLICATIONS

This application is a continuation-in-part of my copending application Ser. No. 797,256, filed May 16, 1977 now abandoned, which is a continuation-in-part of my application Ser. No. 657,472, filed Feb. 12, 1976, now U.S. Pat. No. 4,023,554, and Ser. No. 681,456, filed Apr. 29, 1976, now U.S. Pat. No. 4,049,939.

SUMMARY OF THE INVENTION

This invention relates to a self-contained three-pane window unit which is equipped with a microwave shield and is thus particularly adapted for use in a microwave oven.

In accordance with the specific construction about to be described, the self-contained window unit comprises a window sub-assembly having a pair of glass panes held in spaced parallel relation by a clamping frame of electrically-conducting material which has an integral mounting flange extending around the four sides of the window unit. The microwave shield has its peripheral edge portion in substantially continuous electrical contact with the mounting flange. Fasteners along the four sides of the window unit secure the mounting flange and the peripheral edge portion of the microwave shield to brackets on one of the door panels to both mount the window unit and ground the microwave shield. The unit provides a built-in mounting flange and the shield is grounded at several points along the four sides of the window unit to completely dissipate any microwave radiation. A third glass pane is secured to the clamping frame by a plurality of spaced mounting clips.

The use of spaced mounting clips for the third pane of the self-contained window unit minimizes thermal conduction and provides for maximum air flow in the spaces between the clips.

This self-contained window unit is particularly adapted for use in microwave ovens equipped for pyrolytic self cleaning. No other shielding devices are necessary during the pyrolytic cleaning process.

Other objects and features of this invention will become more apparent as this description proceeds, especially when taken in conjunction with the accompanying drawings wherein.

Figure 1:
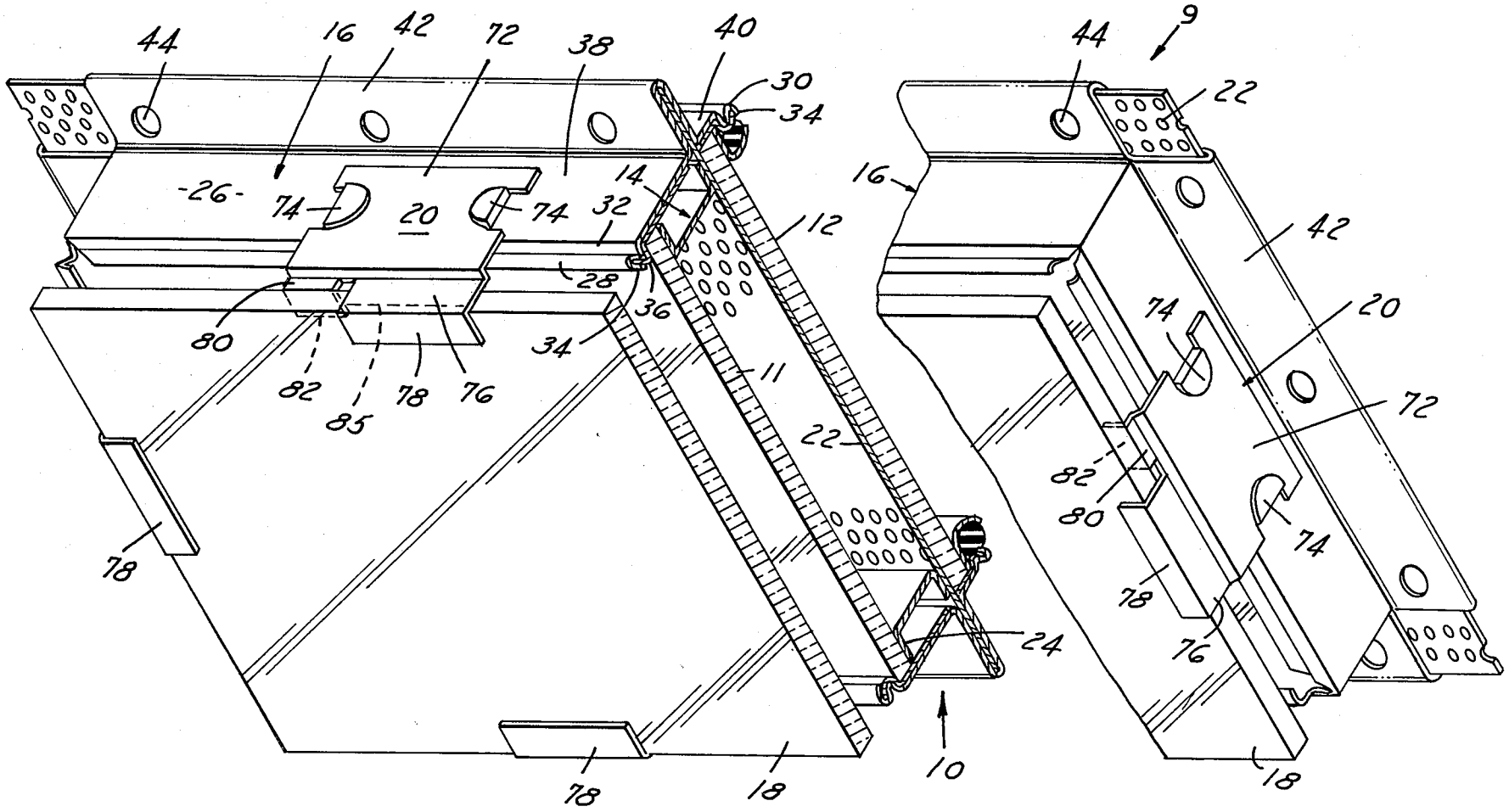
FIG. 1 is a perspective view with parts broken away and in section of a self-contained window unit embodying my invention.
Figure 2:
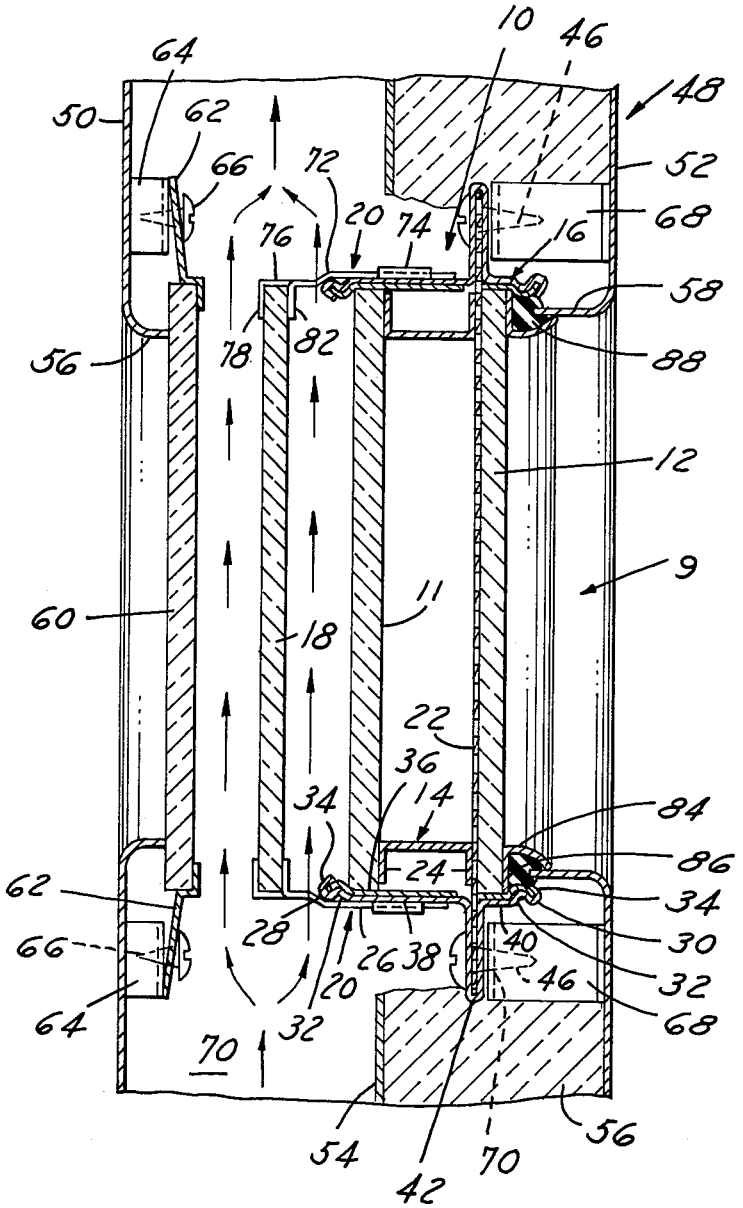
FIG. 2 is a fragmentary vertical sectional view showing the self-contained window unit of FIG. 1 mounted in an oven door.

Referring now more particularly to the drawings, the self-contained window unit 9 comprises a window sub-assembly 10 having rectangular glass panes 11 and 12 maintained in spaced parallel relationship by a spacer 14 and a clamping frame 16. A rectangular front glass pane 18 is secured to the sub-assembly 10 in spaced parallel relation in front of pane 11 by mounting clips 20 along the top, bottom and side edges of the window unit.

A rectangular microwave shield 22 parallel to and between glass panes 11 and 12 is disposed in surface-to-surface contact with the inner face of the pane 12. The shield is formed of electrically conducting metal and has numerous perforations of a size to prevent microwave radiation from passing through but large enough to permit the oven chamber to be viewed from the outside.

The spacer 14 is a rectangular member of channel cross section having radially outwardly turned flanges 24 in contact with the inner peripheral surfaces of the glass pane 11 and the shield 22.

The clamping frame 16 is a rectangular member formed of electrically conducting metal. The clamping frame is generally channel shaped in cross section having a base 26 extending across the space between the glass panes 11 and 12 and having laterally inwardly extending retaining flanges 28 and 30 along the outer peripheral surfaces of the panes. Specifically, each flange 28, 30 has a portion 32 which extends from the base 26 laterally inwardly along the peripheral edge portion of the outer surface of the adjacent glass pane, and a generally U-shaped terminal portion 34 which opens inwardly toward the outer surface of the adjacent glass pane. A strip of asbestos tape 36 lines the inner surface of the base 26 as well as the inner surfaces of the retaining flanges 28 and 30 and is clamped in the terminal portions 34 thereof.

The base of the clamping frame 16 on each of the four sides thereof is divided into front and rear portions 38 and 40 by an integral generally U-shaped section 42 which extends laterally outwardly beyond the base 26 and constitutes a mounting flange. This mounting flange 42 extends continuously along the top, bottom and side edges of the window unit, being interrupted only at the corners as shown in FIG. 1. The reason for the corner interruptions is that the clamping frame is initially made of a length of stock which is bent into rectangular shape.

The microwave shield 22 is both wider and longer than the glass panes 11 and 12 so that it extends outward beyond the peripheries of the glass panes along all four sides. Thus the peripheral portions of the microwave shield along the top, bottom and side edges project into the U-shaped mounting flange 42. The shield cuts through the asbestos tape.

The top, bottom and side portions of the mounting flange 42 are formed with apertures 44 which extend through both parts of the U-shaped section. The top, bottom and side peripheral edge portions of the microwave shield received in the mounting flange are formed with apertures which register with the apertures 44 in the mounting flange. These apertures are for receiving mounting bolts 46.

The window unit is shown installed in an oven door 48 which has a front door panel 50 and a back door panel 52 and an intermediate panel 54 with insulating material 56 between the panels 52 and 54. The rear door panel is of electrically conducting metal. The front panel 50 has an annular rearwardly turned flange 56 and the rear panel 52 has an annular forwardly turned flange 58. The flanges 56 and 58 define registering apertures constituting the opening of the oven door in which the window unit 9 is installed. A front glass pane 60 is clamped to the flange 56 of the front door panel 50 by stops 62 secured to brackets 64 by fasteners 66. Brackets 64 are secured by any suitable means to the door panel 50 which may be of porcelain, for example. In place of the front panel 50 and glass 60, a full glass front may be employed.

The window unit is mounted in the door within the opening thereof by means of the bolts 46 and a plurality of generally Z-shaped brackets 68. These bolts 46 and brackets 68 are formed of electrically conducting metal. Each bracket 68 has one leg welded or otherwise permanently secured in surface-to-surface electrical contact to the inner surface of the rear door panel 52. The other leg is in full surface contact with the mounting flange 42 and has a threaded aperture 70. These brackets 68 are arranged around the four sides of the window opening in the oven door in positions to receive the mounting bolts 46 which extend through the apertures in the mounting flange 42 and in the microwave shield 22. The mounting bolts 46 extend through such apertures and thread into the apertures 70 in the brackets 68 to securely mount the window unit to the rear panel of the oven door. The bolt head bears in electrical contact against one side of the mounting flange 42 and clamps the mounting flange in electrical contact with the microwave shield 22 and against the apertured leg of bracket 68.

It will be understood that before the mounting bolts 46 are applied, the width of the space within the mounting flange 42 is greater than the thickness of the microwave shield. Accordingly, when the bolts 46 are tightened to draw the head of each bolt toward the apertured leg of a bracket 68, the mounting flange 42 is compressed into tight electrical contact with both sides of the peripheral portion of the microwave shield, at the same time drawing the flanges 28 and 30 of the clamping frame 16 toward one another tightly against the outer surface of the glass panes 11 and 12 and this provides a substantially rattle-proof assembly. The edges of the glass panes as well as the outer peripheral surfaces thereof are contacted by the asbestos tape 36 to cushion the assembly thereby preventing breakage, and also forming a seal to keep oven vapors from escaping.

In use, the mounting by the bolts 46 and brackets 68 to the mounting flange at points along each of the four sides of the window unit provides a secure mounting for the window unit and also grounds the microwave shield at each mounting point. Thus microwave radiation impinging upon the microwave shield at any point on its surface is immediately dissipated through the nearest mounting bolt and bracket to the back panel of the door.

An annular trim ring or moulding 84 of generally J shape in cross section extends around the outer peripheral surface of the rear glass pane 12. The trim ring or moulding 84 has a radially outwardly extending leg 86 which extends between and contacts the outer peripheral surface of pane 12 and the asbestos tape 36 along a flange portion 32 of the frame 16. An elongated asbestos cord 88 extends within the trim ring and seals against the edge of flange 58 of the inner door panel 52 when the window unit is installed in the door. Instead of asbestos, the cord may be of fiberglass or in the form of a silicone extrusion.

The asbestos strip 36 lining the flange portions 32 of the frame 16 engages the outer surface of the front panel 11 and the leg 86 of the trim ring 84, and the spacer flanges 24 engage the inner surface of pane 11 and shield 22 to clamp the window sub-assembly 10 together and form a sealed package.

The self-contained window unit 9, as before stated, includes in addition to the glass panes 11 and 12 a front glass pane 18 secured to the sub-assembly 10 by mounting clips 20 spaced apart along the top, bottom and side edges of the window unit. One or more of the clips 20 are provided on each side edge of the window unit and one or more of the clips 20 are provided along the bottom edge and also along the top edge thereof. The clips 20 at the top and bottom of the unit are spaced apart to provide openings communicating with the air passage 70 between panels 50 and 52 in the door to allow air to flow upwardly between panes 11 and 18. Air, of course, also flows upwardly between panes 18 and 60. This dual air wash across the pane 18 maximizes the dissipation of heat, and the use of clips to mount the pane 18 minimizes thermal conduction to pane 18.

Each clip 20 has a plate portion 72 which is secured to the base 26 of the clamping frame 16 as by means of integral tabs 74 on the clamping frame. A leg 76 of the clip 20 projects forwardly from the plate portion 72 across the peripheral edge of the front pane 18 and has a laterally inwardly turned flange 78 extending over the front peripheral surface of the front pane 18. A second leg 80 extends forwardly from the plate portion 72 of clip 20 and terminates in a laterally inwardly turned flange 82 which extends over the rear peripheral surface of the pane 18.

The flanges 78 and 82 of clips 20 clamp the front pane 18 against forward or rearward movement. The legs 76 of the clips prevent sidewise as well as upward and downward movement of the pane. However, the pane 18 is removable from the assembly by bending one or more of the clips laterally outwardly to release the pane. This may or may not result in a deformation of the clips depending upon the springiness of the material from which they are made. In some instances, it is desirable to remove the pane 18 temporarily so that the inner surfaces of the panes 11 and 18 may be cleaned. Even if there is some deformation of the clip flanges resulting from the release and removal of the pane 18, these clip flanges may be bent back into position to retain the cleaned pane 18 after it is reassembled into the window unit.

The dot-dash line 85 in FIG. 1 illustrates a modified clip construction that may, if desired, be employed along the top edge to make it easier to release and remove the pane 18. In the modified clip construction, the flange 78 is omitted and the leg 76 terminates at the line 85 so as to extend only part way across the top peripheral edge of the pane 18. In a broad sense, the leg 76 could conceivably extend entirely across the top edge of the pane 18 and even slightly although not appreciably therebeyond. Preferably however, the leg 76 would be as shown and terminate at the line 85 in the drawings. Use of this modified clip construction along the top permits easier removal of the pane 18. The pane may be pressed outward at the top a distance sufficient to clear the foreshortened leg 76 and then removed by an upward sliding movement.

The type of glass used for the various panes may vary depending upon individual preferences and/or applications. The pane 11 may be of a borosilicate composition for high temperature applications such, for example, as ovens equipped for pyrolytic self-cleaning. The pane 11 may be of tempered glass with or without a heat reflective coating, such, for example, as tin oxide. The pane 18 may be of raw or tempered glass with or without a heat reflective coating.

When the self-contained window unit is installed in the door, the microwave shield is positively grounded to the door frame. Moreover, use of the unit in conjunction with a full or partial glass in the front door panel eliminates the need for any additional shielding device during the pyrolytic cleaning process. The clip type mounting of the pane 18 minimizes thermal conduction and the position of the pane 18 within the door provides a dual air wash which maximizes dissipation of heat.

The pane 18 of the self-contained window unit is removable for cleaning as noted above, after removal of the front door panel 50 either by swinging it down or by separating it completely from the inner door panel.

What I claim as my invention is:

1. A self-contained window unit adapted to be assembled into an oven door having front and back panels with aligned window openings therein and means defining an air passage to allow air to flow upwardly through the door and window unit therein, comprising a window sub-assembly having a pair of glass panes, means to hold said panes in spaced parallel relation, a third glass pane, and means for securing said third glass pane to said window sub-assembly in a position at one side thereof and in spaced parallel relation to the adjacent glass pane of said sub-assembly, said securing means providing areas between said third pane and said adjacent pane of said sub-assembly at the top and bottom of said window unit defining an opening adapted to communicate with the air passage in the door to allow the air to flow upwardly therebetween, said holding means comprising a frame of electrically-conducting material extending about the peripheries of said pair of panes and having a mounting flange, a microwave shield having an edge portion in surface-to-surface electrical contact with said flange, and means for securing said flange to one of said door panels to mount said window unit and ground said shield.

2. The self-contained window unit defined in claim 1, wherein said means for securing said flange comprises fasteners provided at spaced points along said flange.

3. The self-contained window unit defined in claim 1, wherein said means for securing said third pane to said window sub-assembly comprises a plurality of spaced mounting clips.

4. The self-contained window unit defined in claim 3, wherein said mounting clips include bottom and side clips at the bottom and side edges of said window unit engaging peripheral portions of said third pane.

5. The self-contained window unit defined in claim 4, wherein each bottom and side clip has a part extending over the peripheral edge of said third pane and inner and outer flanges extending over the inner and outer peripheral surfaces respectively of said third pane.

6. The self-contained window unit defined in claim 4, wherein said mounting clips include at least one top clip at the top of said window unit engaging a top peripheral portion of said third pane.

7. The self-contained window unit defined in claim 6, said top clip having a flange extending over the inner peripheral surface of said third pane, said top clip also having a terminal part extending over the peripheral edge of said third pane but not appreciably therebeyond so as normally to releasably hold said third pane against upward movement but permitting said third pane to be pressed outwardly clear of said terminal part for upward removal.

8. The self-contained window unit defined in claim 1, wherein said mounting flange extends laterally outwardly beyond said pair of glass panes about substantially the entire peripheries thereof, said edge portion of said microwave shield about substantially the entire periphery thereof being in electrical contact with said flange, and said means for securing said flange comprises metal fasteners provided at spaced points along the peripheral extent of said flange.

9. The self-contained window unit defined in claim 1, wherein said frame is generally channel-shaped in cross section having a base extending across the space between said pair of glass panes and laterally inwardly extending retaining flanges engaging the outer peripheral surfaces thereof, said base being divided into front and rear portions by an integral generally U-shaped section extending laterally outwardly beyond said pair of glass panes about substantially the entire periphery thereof and constituting said mounting flange, the edge portion of said microwave shield extending into said U-shaped section, and said means for securing said mounting flange to one of said door panels comprising metal fasteners clamping said edge portion of said microwave shield within said U-shaped section.

10. The self-contained window unit defined in claim 9, wherein the width of the space within said U-shaped section in its free state condition is greater than the thickness of said shield, said fasteners compressing said U-shaped section into clamping engagement with the edge portion of said shield and also drawing said retaining flanges into pressure contact with the outer peripheral surfaces of said pair of glass panes.

11. The self-contained window unit defined in claim 3, wherein said mounting clips include top, bottom and side clips at the top, bottom and side edges of said window unit engaging peripheral portions of said third pane.

12. The self-contained window unit defined in claim 11, said top clip having a flange extending over the inner peripheral surface of said third pane, said top clip having a terminal part extending part way only over the peripheral edge of said third pane so as normally to releasably hold said third pane against upward movement but permitting said third pane to be pressed outwardly clear of said terminal part for upward removal.

13. A self-contained window unit adapted to be assembled into an oven door having front and back panels with aligned window openings therein and means defining an air passage to allow air to flow upwardly through the door and window unit therein, comprising a window sub-assembly having a pair of glass panes, means to hold said panes in spaced parallel relation, a third glass pane, and means for securing said third glass pane to said window sub-assembly in a position at one side thereof and in spaced parallel relation to the adjacent glass pane of said sub-assembly, said securing means providing areas between said third pane and said adjacent pane of said sub-assembly at the top and bottom of said window unit defining an opening adapted to communicate with the air passage in the door to allow the air to flow upwardly therebetween, said holding means comprising a frame of electrically-conducting material extending about the peripheries of said pair of panes and having a mounting flange, a microwave shield extending parallel to said pair of panes and having an edge portion overlying said mounting flange, and means for clamping said edge portion of said shield and said flange together and for securing said flange to one of said door panels to both mount said window unit and ground said microwave shield.

14. An oven door having front and back panels with aligned window openings therein and means defining an air passage to allow air to flow upwardly through the door, a self-contained window unit mounted in said door between said panels in register with the openings therein including a window sub-assembly having a pair of glass panes, means to hold said panes in spaced parallel relation, a third glass pane, means for securing said third glass pane to said window sub-assembly in a position at one side thereof and in spaced parallel relation to the adjacent glass pane of said sub-assembly, said securing means providing areas between said third pane and said adjacent pane of said sub-assembly at the top and bottom of said window unit defining an opening adapted communicate with the air passage in the door to allow the air to flow upwardly therebetween, and a fourth glass pane mounted on one of the door panels in register with the window opening therein and in spaced relation to said third glass pane to provide an opening therebetween communicating with the air passage in the door to allow the air to flow upwardly therethrough.

15. The self-contained window unit defined in claim 15, wherein said securing means for said third glass pane comprises a plurality of spaced mounting clips.

16. The oven door defined in claim 15, wherein said mounting clips include bottom and side clips at the bottom and side edges of said window unit engaging peripheral portions of said third pane.

17. The oven door defined in claim 14, wherein said holding means comprises a frame of electrically conductive material extending about the peripheries of said pair of panes and having a mounting flange, a microwave shield having an edge portion in surface-to-surface electrical contact with said flange, and means for securing said flange to one of said door panels to mount said window unit and ground said shield.

18. The oven door defined in claim 17, wherein said mounting flange extends laterally outwardly beyond said pair of glass panes about substantially the entire peripheries thereof, said edge portion of said microwave shield about substantially the entire periphery thereof being in electrical contact with said flange, and said means for securing said flange comprises metal fasteners provided at spaced points along the peripheral extent of said flange.

19. The oven door defined in claim 17, wherein said frame is generally channel-shaped in cross section having a base extending across the space between said pair of glass panes and laterally inwardly extending retaining flanges engaging the outer peripheral surfaces thereof, said base being divided into front and rear portions by an integral generally U-shaped section extending laterally outwardly beyond said pair of glass panes about substantially the entire periphery thereof and constituting said mounting flange, the edge portion of said microwave shield extending into said U-shaped section, and said means for securing said mounting flange to one of said door panels comprising metal fasteners clamping said edge portion of said microwave shield within said U-shaped section.

20. The oven door defined in claim 19, wherein the width of the space within said U-shaped section in its free state condition is greater than the thickness of said shield, said fasteners compressing said U-shaped section into clamping engagement with the edge portion of said shield and also drawing said retaining flanges into pressure contact with the outer peripheral surfaces of said pair of glass panes.

* * * * *